United States Patent [19]

Clapp

[11] 4,170,241

[45] Oct. 9, 1979

[54] APPARATUS FOR CLEANING CONTAINERS

[75] Inventor: John W. M. Clapp, Luton, England

[73] Assignee: Thermoplastic Compounders Limited, Luton, England

[21] Appl. No.: 886,606

[22] Filed: Mar. 14, 1978

[30] Foreign Application Priority Data

Mar. 15, 1977 [GB] United Kingdom ..... 10998/77

[51] Int. Cl.[2] ..... B08B 3/02

[52] U.S. Cl. ..... 134/83; 134/104; 134/184

[58] Field of Search ..... 134/62, 82–83, 134/104–105, 165, 184, 141, 1

[56] References Cited

U.S. PATENT DOCUMENTS

| | | | |
|---|---|---|---|
| 1,736,846 | 11/1929 | Cole et al. | 134/83 X |
| 2,949,121 | 8/1960 | Kearney | 134/105 X |
| 3,306,309 | 2/1967 | Pahl et al. | 134/141 X |
| 3,447,545 | 6/1969 | Lawter | 134/109 X |

FOREIGN PATENT DOCUMENTS

| | | | |
|---|---|---|---|
| 119248 | 5/1917 | United Kingdom | 134/165 |
| 1203977 | 9/1970 | United Kingdom | 134/62 |
| 282887 | 3/1971 | U.S.S.R. | 134/83 |
| 452941 | 5/1975 | U.S.S.R. | 134/83 |

*Primary Examiner*—Robert L. Bleutge

*Attorney, Agent, or Firm*—Cushman, Darby & Cushman

[57] ABSTRACT

Apparatus for cleaning containers which passes the containers submerged through a tank of detergent solution at elevated temperature while subjecting the solution in the tank to ultrasonic vibratory energy. The residence time of the containers in the solution, the temperature of the solution, the detergent type and concentration, and the frequency and intensity of the ultrasonic vibratory energy are sufficient to remove dirt from the containers, even grey film from plastics containers such as milk bottle crates.

15 Claims, 11 Drawing Figures

APPARATUS FOR CLEANING CONTAINERS

This invention relates to apparatus for and methods of cleaning containers, particularly containers made of plastics and particularly to cleaning reusable transport containers such as plastics crates.

While the apparatus of the present invention will be described with specific reference to cleaning plastics bottle-crates, i.e., crates used for carrying bottles of milk, beer and soft-drinks, it may be used for cleaning analogous articles such as cases, baskets, trays and boxes and like containers made of plastics, metal or glass, as used in the food processing and distribution industries.

Crates become dirty during use and are usually cleaned after each use. Injection moulded plastics are of an intricate construction consisting of support partitions, strengthening ribs, tine apertures hand hold recesses, base features and the like. The dirt which builds up on these crates in use is of two types: surface soiling (which may become ingrained) and static soil—the latter is particular only to plastics and takes the form of a tenacious grey film.

Traditional washing machines work on the principle of jetting liquid detergent at high pressure. In spite of regular cleaning using traditional machines, the crates rapidly lose their gloss (due to the inability of high pressure jetting to remove the grey film) and gradually accumulate areas of permanent dirt, particularly in blind spots which cannot be penetrated by the mechanical sluicing action of the jets.

The crates accordingly become unsightly and eventually the bacteria harboured in the dirt building up on all surfaces may infringe public hygiene regulations.

We have now found that crates may be brought to a state of 'new cleanliness' on all surfaces and thereafter maintained clean if they are regularly treated to a particular type of cleaning process.

According to the present invention there is provided a method of treating crates or the like which comprises submerging and passing the crates through a tank of hot detergent solution while simultaneously subjecting the solution to ultrasonic vibratory energy, the residence time of the crates in the solution, the temperature of the solution, the detergent type and concentration and the degree of ultrasonic actuation being sufficient to remove dirt from the crates, preferably to remove grey film from plastics crates.

The ultrasonic actuation produces cavitation phenomena in the solution, giving cleaning by a thorough but gentle scrubbing action on every surface of the crate, inside and out.

The crate should be wholly immersed in the hot detergent solution in order to clean all the submerged surfaces. In order to achieve this with crates which are less dense than water, it is desirable to provide a mechanical guidance system to ensure that the crates are held below the surface of the hot detergent during their passage through the tank. A highly preferred method of effecting this is a system of guide rails together defining a channel through which a succession of crates may be pushed, e.g., by either a reciprocating pneumatic or hydraulic piston with latch assembly or by a chain conveyor with dogs, powered by an electric motor. The guide rails should be arranged so that their contour at the points where the crates submerge into and emerge from the solution allow the ends of the crates automatically to separate and the upper surface of the channel that they define should lie below the upper surface of the solution in the detergent tank whilst passing over the ultrasonic transducers. Such a system minimises the mechanical handling of the crates through the tank, each crate simply pushing the next, and avoids the need both for a traditional motorised chain conveyor and mechanical provision for crate separation. In a highly preferred system the guide rails may be extended so as to guide the crates on through the rinse and drying sections of the machine. Preferably the guide rails are stepped down between the detergent wash tank and the rinse section and again between the rinse section and the drying section, so as to effect knock-off of liquid. The guide rails may be spiralled so as to effect inversion of crates.

The solution in the detergent tank is preferably maintained at a temperature of at least 65° most preferably at 70°-75° C.

The detergent tank preferably contains a nonfoaming detergent of a type and at a concentration depending upon the nature of dirt to be removed and upon the degree of cleaning required. For Health and Safety at work, liquid detergents are preferred. Powder detergents may also be used. For plastics crates a blend of alkalis containing non-ionic detergent is preferred to effect dirt removal, e.g., grease, fat, blood and other proteinaceous soiling, as it effects cleaning by improved soil suspension and emulsification and supresses foam. Silicate is preferably blended with the alkalis to act as a corrosion inhibitor in known fashion, which enables the detergent to be used on reactive metals. The detergent may be colour coded for Health and Safety at Work—but not excessively so. The detergent should be unperfumed, so as to leave no taint or smell. Such detergent products are known as such and commercially available.

In many areas of application of the method of the present invention, all that is required is that crates which are continually subjected to the method gradually become cleaner rather than dirtier. For regular maintenance cleaning of new crates the preferred detergent concentration is 0.5 to 1% by weight. If the method of the present invention is adopted for cleaning crates which have already become soiled through service, then the detergent concentration may be increased, e.g., to 2% by weight until the accumulated dirt on the crates has all been removed. Automatic means of known types, preferably incorporating a diaphragm pump type dispenser, may be provided in order automatically to control the detergent concentration to the desired level.

In order to avoid any appreciable detergent loss from the wash tank (through drag-out of liquid on the crates, resulting in carry-over of detergent into the rinse section) a preferred system incorporates a drip tray between the wash tank and the rinse section. This, coupled with the contour of the guide rails and the residual latent heat of the crates, allows the crates to drain and flash dry prior to entering the rinse section, the drainings returning to the detergent tank. For high line speeds the aforementioned step in the guide rails accelerates natural drainage, though drying may not be achieved before the rinse section.

After the crates have passed through the detergent tank they are preferably rinsed, e.g., with hot or cold water jets at low pressure (e.g., 2.8 kg/cm$^2$) so as to remove residual detergent but so as not to re-deposit a static charge. In a particularly preferred arrangement, especially for line speeds in excess of 20 crates/minute, rinsing takes place in two stages, a first stage (situated beyond the point of emergence of the crates from the detergent solution and at the point where the ends of the crates are separated) comprising a low (e.g., 2.8 kg/cm$^2$) or medium (e.g., 5.6 kg/cm$^2$) pressure manifold of large orifice jets which recycles detergent from the wash tank and which removes soil loosened during the passage through the wash tank but not yet removed by large scale mechanical action. Loosened dirt removed by the first rinsing is returned to the detergent tank but in the second stage the rinse water is relatively clean and may usefully be recycled or partially run to waste.

Operating the method of the present invention, dirt is removed from the crates and comes to be present, held in suspension, in the hot detergent solution. This is clearly undesirable, particularly as such dirt tends not to settle out on the bottom of the tank but tends, due to the ultrasonic energy, to be broken down into a fine particulate size. Accordingly, it is highly preferred to withdraw soiled detergent solution continuously from the tank, subject it to centrifugal clarification and return clarified detergent solution to the tank. Suitable centrifugal clarification apparatus is known as such and commercially available. In such apparatus the liquid to be clarified is accelerated centrifugally at very high speeds and any dirt particles therein, e.g., above 10 micron size, are deposited on a rubber liner or like bowl. Such a bowl is simply removable and accumulated dirt solids can be removed as a damp cake or sludge therefrom at regular intervals.

The centrifugal action tends to cause the detergent solution to foam. This foaming is accentuated when saponification occurs, e.g., the conversation of proteinaceous fats by alkali detergents into soap. Foaming can impair the clarifying action of the centrifuge and excessive foaming impedes the return of clarified liquid to the wash tank. Accordingly, it is preferred to provide a holding tank, at the rear of the centrifuge, into which the clarified detergent solution is fed and in which a constant water level is maintained, e.g., by a conventional ballcock. This allows excessive foam to flow over a weir a little above the water level on the tank to waste. In such a system, foam removal over the weir is preferably assisted by incorporating in the holding tank a mains water supply directed through a spray nozzle, which urges the foam to flow to waste.

To prevent the jet nozzles from blocking in a low pressure final rinse section of the type noted above, a hydrocyclone may be located between a rinse water pump and the rinse manifold. Suitable hydrocyclone apparatus is known and commercially available. In such apparatus the rinse water to be clarified is centrifugally accelerated and dirt particles therein, e.g., of size above 20 microns, are discharged, together with a controlled amount of rinse water, to waste. It is highly preferred to feed such discharged rinse water to aid the flow of stabilised foam in the holding tank as described above from the weir to waste.

In addition to the fine dirt which is removed from the crates in the detergent bath, crates often are contaminated with large scale debris e.g. pieces of paper, leaves and the like and this tends to float to the surface of the solution in the detergent tank. In order to remove such gross contamination it is preferred to have a weir at the exit end of the tank over which liquid in the tank flows into a chamber containing a wire mesh basket and successively finer mesh sheet filters which may be removed for cleaning at regular intervals. One outlet of such a chamber may gravity feed to the detergent solution still containing finely dispersed solids to the centrifugal clarifier mentioned above and another outlet can provide traditional protection for the pump and jets of the first stage of the aforementioned detergent rinse.

The weir outlet is preferably a non-vertical wall extending outwardly away from the centre of the tank in order to reduce the tendency of any material floating on the surface to be carried downwards rather than over the weir.

There is naturally a tendency for heavy contaminating solids, e.g., sand, to drop to the bottom of the tank containing detergent and means such as so-called 'sludge doors' are preferably provided for cleaning the base of the tank at regular intervals.

A variety of ultrasonic generators and transducers is available commercially. It is preferred in the process of the present invention to use, removable, submersible transducers to subject the crates to ultrasonic vibration in the detergent tank at a frequency of at least 25 KHz, preferably 40 KHz, using piezo-electric transducers. Magneto-strictive transducers, although they usually operate at somewhat lower frequencies, e.g., 20 KHz, can also be used.

The geometrical arrangement of the transducers is of importance. Preferably, the transducers are mounted on the base of the tank and preferably the crates are caused to pass over at least two ultrasonic vibration transducers one after the other. In a highly preferred arrangement, these transducers are directed each slightly inclined to the horizontal so that the predominant direction of the ultrasonic radiation is inclined slightly from the vertical. Each transducer can also be offset from the centre-line of the tank by a short distance. Seen in the direction of movement of the crates through the tank, it is preferred to incline one ultrasonic generator to one side of the vertical and the other to the other. This tends to avoid "blind spots" in the tank and to ensure that the crates as they pass through the tank are subjected overall to ultrasonic vibration to clean them.

Additional submersible transducers may be mounted on each side of the tank so as to provide added cleaning power.

The residence time of the crates in the detergent solution and the dwell time of the crates above the transducers when carrying out the method of the present invention may vary widely but is is preferably not less than 12 seconds and 6 seconds respectively. Submersion times of 18 seconds and dwell times of 9 seconds are convenient for many purposes. Longer dwell times may of course be used with especially dirty crates, but it is to be noted that the method of the present invention succeeds in cleaning crates more by repetitive nature of a cleaner crate each time, rather than being designed to remove all accumulated contamination at once.

The detergent tank and rinse section (if hot) may be maintained hot by any convenient means, e.g., preferably by steam pipes or immersion heaters or, alternatively, by direct injection of steam. Naturally the outside of the tank may be thermally insulated to reduce the energy cost of maintaining the solution in the tank hot. Also, the top of the tank may be provided with an optionally thermally insulated lid or cover.

The apparatus in which the process of the present invention is carried out may be made from any convenient materials: the detergent tank is most preferably made of stainless steel to withstand the erosive cavitation effects to which it is subjected. Care must naturally be taken not to use reactive materials in contact with the detergent which would be attacked thereby, e.g., aluminum, zinc and light alloys which are adversely affected by alkaline detergents.

The method and apparatus of the present invention may be used in a wide-variety of applications. In particular, the present invention finds application in dairies, bakeries and meat factories which despatch their products in returnable plastics crates.

The invention is illustrated by way of example with reference to the accompanying drawings which show schematically a crate washing apparatus. In the drawings.

Figure 1:
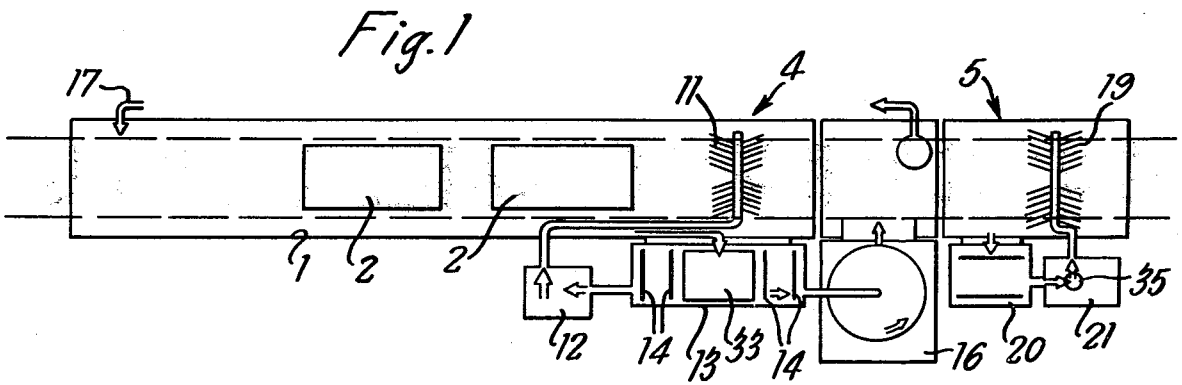
FIG. 1 is a schematic general plan view of a container cleaning apparatus according to the present invention.
Figure 2:
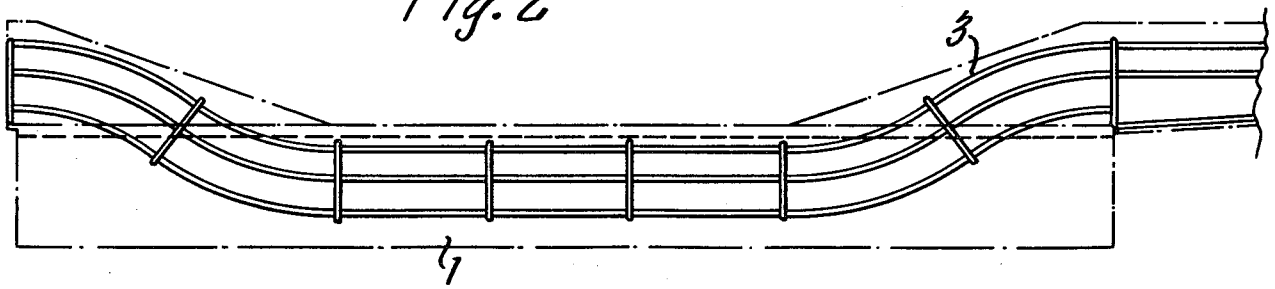
FIG. 2 is a schematic side view showing the guide rail system thereof on a slightly enlarged scale.

Referring to the drawings, the apparatus consists generally of a framework on and in which the various components are mounted. The principal components are a detergent solution tank 1, a pair of ultrasonic transducers 2, a guide rail system 3, a first rinse section 4, and a second rinse section 5.

The guide rail system 3 has an inlet end seen towards the left in the various drawings and consists of a number of longitudinal guide rails held in frame. The path defined between the guide rails passes down into the tank 1, and up again through rinse sections 4 and 5. The guide rail system may extend into and through an appropriate dryer.

Figure 3:
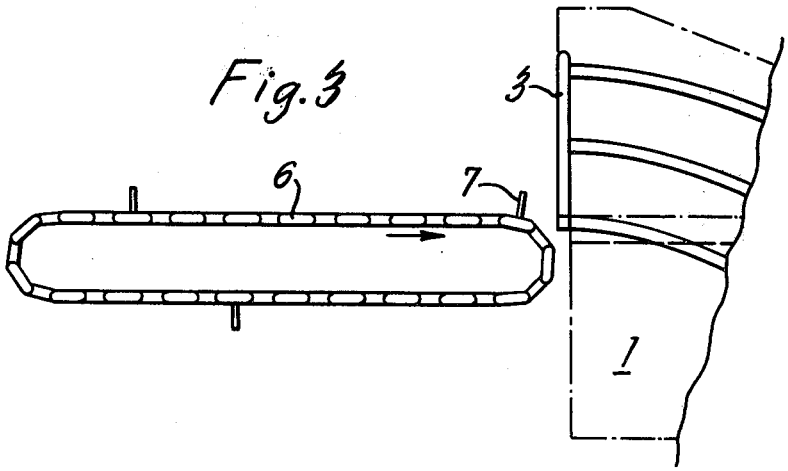
FIG. 3 shows one form of container drive for inserting containers into the apparatus.
Figure 4:
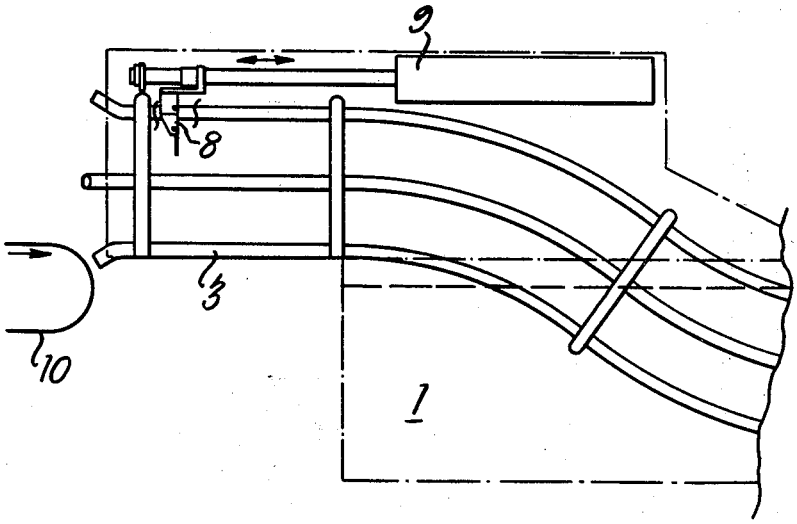
FIG. 4 shows an alternative container drive.

A series of containers to be cleaned are pushed through the guide rail system from the inlet and, e.g., by a constantly rotating chain 6 bearing dogs 7 as shown in FIG. 3 or by a reciprocating latch 8 attached to a piston cylinder device 9 as shown in FIG. 4. In the case of the system shown in FIG. 4, a conveyor belt 10 which may constitute part of the apparatus but will usually be a conveyor already installed in a dairy, brewery or the like, is arranged to feed the containers into the entry end of guide rail system 3. As the piston rod of piston cylinder device 9 carrying latch 8 moves to and fro as indicated by the arrow, the latch 8 catches on the rear end of successive containers and pushes them through the guide rail system.

Figure 5:
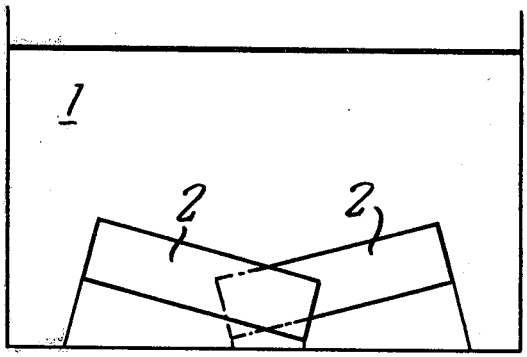
FIGS. 5 and 6 are schematic transverse cross-sections of the apparatus showing the position of ultrasonic transducers.
Figure 6:
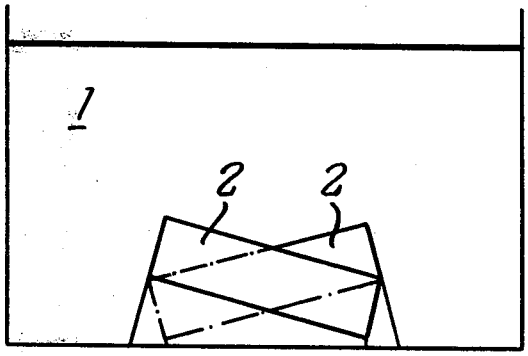
Figure 7:
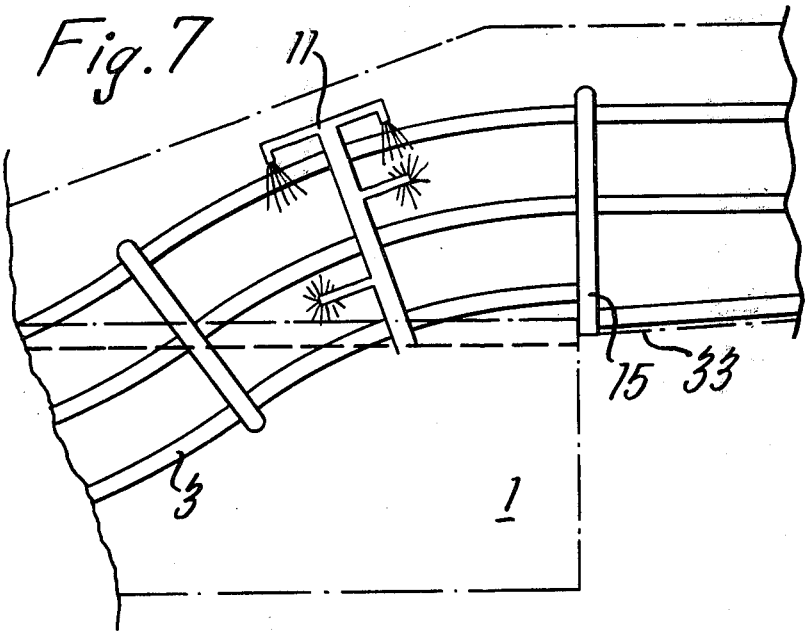
FIGS. 7 and 8 are side and plan views respectively of a first rinsing station.
Figure 8:
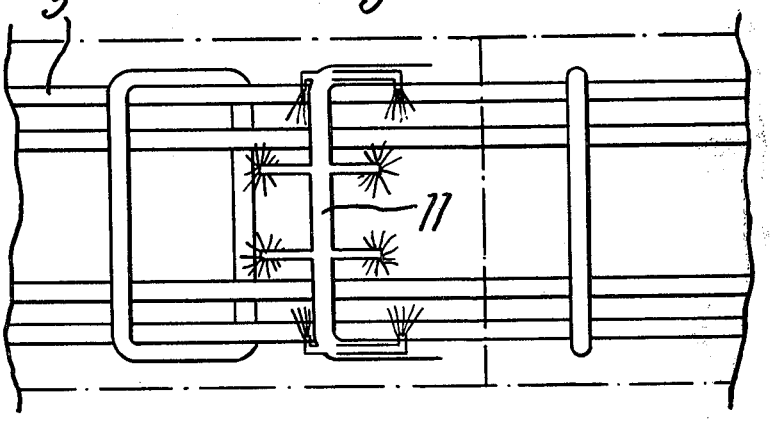
Figure 9:
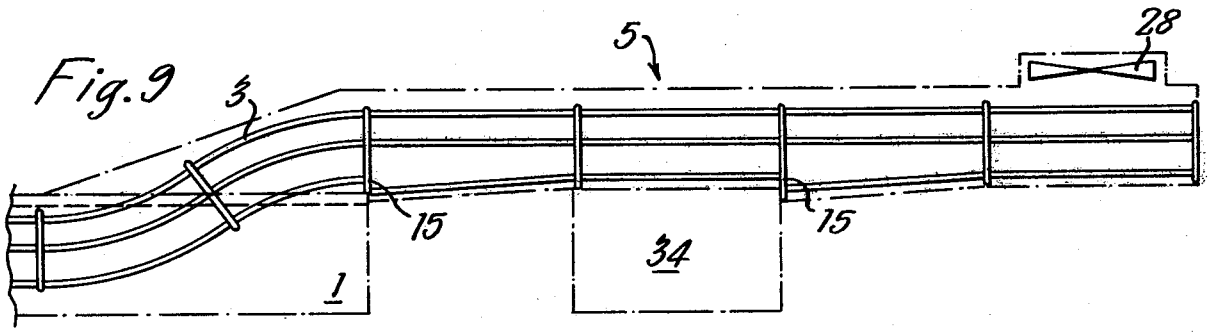
FIG. 9 is a side view showing the rinsing, drying and shaking sections of the apparatus.

Set on the base of tank 1 are a pair of transducers 2 angled relative to one another as shown in FIG. 5 or FIG. 6. Angling the two transducers in this way tends to avoid the creation of any areas within the tank to which the ultrasonic vibratory energy does not penetrate.

After they have passed over the transducers 2, the containers are pushed in the guiderail system 3 out of the detergent solution in tank 1 and they pass through a spray bar system 11 at the first rinse station 4. This spray is fed by a pump 12 which receives detergent solution withdrawn from tank 1 via a buffer tank 13. Buffer tank 13 is provided with a central basket for catching leaves, paper and like and a number of mesh filters 14 to trap smaller particulars which may have been removed from the containers being washed.

Immediately downstream of the rinse station 4 is a drip tray 33 which is inclined downwardly towards tank 1. Detergent solution falling off the containers falls on to tray 33 and is returned to tank 1.

Downstream of each rinsing station 4 and 5 are two steps 15 formed in the floor of guide rail system 3. Each successive container as it is pushed over a step 15 drops on to the succeeding guiderail section with a jerk which aids in dislodging rinsing liquid from the container.

Connected to a second outlet of buffer tank 13 is a centrifugal separator 16 which constantly removes suspended solids from detergent solution removed via tank 13 and pumps it back into tank 1 at point 17 where indicated on FIG. 1. Centrifugal separator 16 is periodically switched off and the cake of deposited solids removed, appropriate valves being provided to enable this to be done at regular intervals without disturbing the smooth running of the machine.

Detergent solution in tank 1 may be maintained at the desired temperature by means of steam pipes or steam injection not shown and the whole of tank 1 is adequately thermally insulated.

Figure 10:
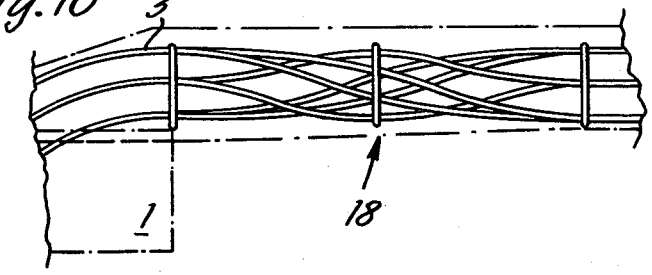
FIG. 10 is a schematic side view of a container inverter.

In order to enhance drainage of detergent solution or rinse liquid from the containers, an inverter section 18 may be provided in guiderail system 3 as shown in FIG. 10. An inverter section is desirable if the crates are fed into the machine upside down.

The second rinse section 5 consists of spray bar 19 around the guide rail system 3. Rinse water at the second rinsing section 5 is recovered in a rinse water tank 34 below the guide rail system, withdrawn over a weir to a buffer tank 20 and pumped by a pump 21 through a hydrocyclone 35 to remove suspended solids prior to being fed into spray bar 19.

Figure 11:
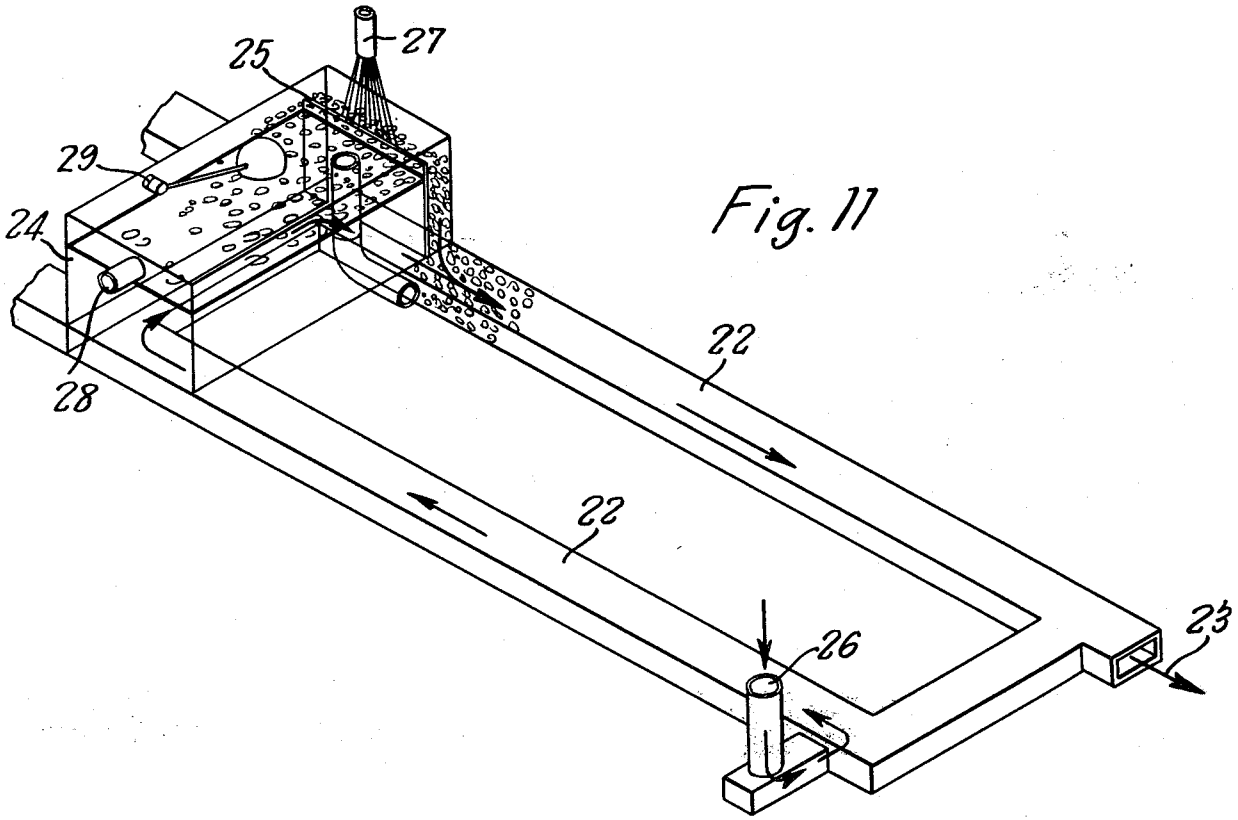
FIG. 11 is a schematic perspective view of part of the apparatus showing foam removal.

In certain applications, the operation of centrifugal clarifier 16 may give rise to the formation of substantial quantities of foam. Such foam is undesirable and may be removed by an arrangement of the type shown in FIG. 11. A controlled discharge of water from the hydrocyclone 35 flows through a pipe 26 and through parts 22 of the base of the machine as indicated by arrows and arrow 23 indicates a final outlet to waste from the apparatus.

Water and foam from the centrifugal separator 16 are fed via a pipe 28 to a holding tank 24 in which the foam stays on the surface and floats across towards a weir 25 at one end of tank 24 to waste. The upper surface of the solution in the tank 24 is maintained at the desired level by a ballcock 29. The flow of foam to waste may be assisted by a water spray 27, fed by water under mains pressure.

Removal of liquid from the containers after they have passed through the second rinse section 5 may be assisted by a fan 28 which blows air, optionally heated, down over the containers.

I claim:

1. Apparatus for cleaning containers comprising a detergent solution tank, a set of guide rails defining a channel for the containers, the channel having an inlet section outside the tank, an immersion section wholly below the surface of the liquid when the tank is filled, and an outlet section, a pusher system means for pushing a sequence of containers sequentially and each pushing the next through the channel, at least one ultrasonic transducer mounted on the base of the tank, means for driving the transducer to impart ultrasonic vibratory energy to liquid in the tank, a rinsing device downstream of the tank and adapted to spray liquid on containers emerging from the tank, means for heating liquid in the tank to an elevated temperature and maintaining the liquid at that temperature, and means for withdrawing a portion of liquid from the tank, removing suspended solids therefrom and returning the liquid to the tank.

2. The apparatus of claim 1 wherein the tank and guide rails are made of stainless steel.

3. The apparatus of claim 1 wherein the guide rails are so shaped that a container is inverted as it passes through the channel.

4. The apparatus of claim 1 wherein the upper guide rails in the immersion section, can be removed to allow access to containers in the tank.

5. The apparatus of claim 1 wherein the floor of the guide rails in the outlet section contains at least one step down as seen in the direction of movement of the containers.

6. The apparatus of claim 1 wherein the pusher system comprises a latch adapted to engage and push each of a sequence of containers, a piston-cylinder device attached to the latch, and means for supplying pressure fluid to the piston/cylinder device to cause the latch to reciprocate adjacent the channel and over a path slightly longer than the length of a container.

7. The apparatus of claim 1 and comprising two ultrasonic transducers mounted on the base of the tank and mounted to radiate ultrasonic vibratory energy predominantly in two different directions.

8. The apparatus of claim 1 wherein the means for driving the transducers are adapted to cause the transducers to radiate ultrasonic vibratory energy at a frequency of at least 25 KHz.

9. The apparatus of claim 1 wherein between the rinsing device and the tank, a drip tray is located beneath the channel arranged to return liquid dropping from the containers to the tank.

10. The apparatus of claim 1 wherein the rinsing device comprises a first low or medium pressure jet manifold and drain means diverting first stage rinse liquid into the tank, and a second rinsing manifold and drain means diverting the second stage rinse liquid at least partly to waste.

11. The apparatus of claim 1 wherein the means for removing solids from liquid withdrawn from the tank is a centrifugal clarifier.

12. The apparatus of claim 11 wherein the outlet of the centrifugal clarifier feeds an intermediate foam removal tank comprising a weir over which foam flows to waste.

13. The apparatus of claim 12 wherein flow of foam over the weir is assisted by a liquid spray directed on to the surface of the liquid in the intermediate foam removal tank and towards the weir.

14. The apparatus of claim 1 wherein the liquid is withdrawn from the tank over at least one outwardly sloping perforate weir and through at least one mesh to collect large size contamination from the liquid in the tank.

15. The apparatus of claim 1 wherein the base of the tank comprises at least one sludge door.

* * * * *